US009603400B2

(12) United States Patent
Kenney et al.

(10) Patent No.: US 9,603,400 B2
(45) Date of Patent: Mar. 28, 2017

(54) GOLF SHIRT WITH IMPROVED FIT AND CONTRAST

(71) Applicant: Nike, Inc., Beaverton, OR (US)

(72) Inventors: Kimberly A. Kenney, Portland, OR (US); Marguerite Hill Nelson, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 246 days.

(21) Appl. No.: 14/281,452

(22) Filed: May 19, 2014

(65) Prior Publication Data

US 2014/0338091 A1 Nov. 20, 2014

Related U.S. Application Data

(60) Provisional application No. 61/824,797, filed on May 17, 2013.

(51) Int. Cl.

| | |
|---|---|
| ***A41D 27/28*** | (2006.01) |
| ***A41D 27/24*** | (2006.01) |
| ***A41D 13/00*** | (2006.01) |

(52) U.S. Cl.

CPC ..... *A41D 27/24* (2013.01); *A41D 13/0015* (2013.01); *A41D 27/28* (2013.01)

(58) Field of Classification Search

CPC .. A41D 13/002; A41D 27/18; A41D 2400/12; A41D 2400/20; A41D 2400/38; A41D 2600/10

USPC ..... 2/98, 129, 131, 132, 139, 255–266

See application file for complete search history.

(56) References Cited

U.S. PATENT DOCUMENTS

| | | | | | |
|---|---|---|---|---|---|
| 1,493,772 | A | * | 5/1924 | Zuck | 2/98 |
| 1,804,346 | A | * | 5/1931 | Kirschenbaum | 2/98 |
| 2,120,147 | A | * | 6/1938 | Ide | 139/385.5 |
| 2,633,576 | A | * | 4/1953 | Powers et al. | 2/60 |
| D170,723 | S | * | 10/1953 | Secosky | D2/849 |
| 2,724,836 | A | * | 11/1955 | Wiedemer | 2/132 |
| 3,478,366 | A | * | 11/1969 | Kaufman | 2/74 |
| 3,725,954 | A | * | 4/1973 | Baldini | 2/143 |
| 3,761,962 | A | * | 10/1973 | Myers | 2/79 |
| 4,569,870 | A | * | 2/1986 | Shinmi | 428/57 |
| 4,604,759 | A | * | 8/1986 | Bowman et al. | 2/81 |
| 4,698,847 | A | * | 10/1987 | Yoshihara | 2/69 |
| 5,105,478 | A | * | 4/1992 | Pyc | 2/115 |
| 5,201,075 | A | * | 4/1993 | Svetich | 2/108 |
| 5,367,708 | A | * | 11/1994 | Fujimoto | 2/22 |
| 5,608,913 | A | * | 3/1997 | Lacoste | 2/115 |
| 5,692,239 | A | | 12/1997 | Lewis | |

(Continued)

*Primary Examiner* — Khaled Annis

(74) *Attorney, Agent, or Firm* — Shook, Hardy & Bacon L.L.P.

(57) ABSTRACT

The present invention is directed to a golf shirt with two laterally-opposed textile bands affixed thereto that are less stretchable than a textile used to construct the torso portion and the shoulder portion of the shirt. A first end of each band is adhered to a skirt of the collar portion, and a second end is adhered to a free end of the shirt. One side of the length of the pair of bands is adhered to the shirt at each point between the first and second end. When the shirt is worn by a person, and the person addresses a golf ball (e.g., extends his arms in front of his body and/or partially clasps his hands together around a golf club), the textile used to construct the bands pulls the sleeve portion away from the wearer and/or decreases a movement associated with the sleeve portion.

20 Claims, 8 Drawing Sheets

(56) References Cited

U.S. PATENT DOCUMENTS

| | | | | |
|---|---|---|---|---|
| 5,694,528 | A | 12/1997 | Hube | |
| 5,745,917 | A * | 5/1998 | Dicker et al. | 2/69 |
| 5,782,191 | A * | 7/1998 | Wong | 112/441 |
| 5,875,491 | A * | 3/1999 | Wilkinson | 2/69 |
| 5,919,539 | A * | 7/1999 | Bisbis et al. | 428/57 |
| 5,960,474 | A * | 10/1999 | Dicker et al. | 2/69 |
| 6,047,405 | A * | 4/2000 | Wilkinson | 2/69 |
| 6,057,253 | A * | 5/2000 | Groshens | 442/313 |
| 6,148,445 | A | 11/2000 | Spruill | |
| 6,176,816 | B1 * | 1/2001 | Dicker et al. | 482/124 |
| 6,231,488 | B1 * | 5/2001 | Dicker et al. | 482/124 |
| 6,250,116 | B1 * | 6/2001 | Groshens | 66/171 |
| 6,305,024 | B1 * | 10/2001 | Schweer | 2/94 |
| D457,709 | S * | 5/2002 | Davis | D2/717 |
| D491,713 | S * | 6/2004 | Wilson, II | D2/849 |
| 38,838 | A1 * | 1/2006 | Foreman et al. | 2/115 |
| 7,043,766 | B1 * | 5/2006 | Foreman et al. | 2/81 |
| 39,083 | A1 * | 1/2007 | Tomann et al. | 2/2.5 |
| 7,356,851 | B2 | 4/2008 | Spruill | |
| 7,913,323 | B2 | 3/2011 | Takamoto et al. | |
| 7,941,871 | B1 | 5/2011 | Jorgensen | |
| 8,065,746 | B2 * | 11/2011 | Keeter | 2/129 |
| 8,087,095 | B2 | 1/2012 | Maier | |
| 8,533,864 | B1 * | 9/2013 | Kostrzewski | 2/69 |
| 41,730 | A1 * | 1/2014 | Baron et al. | 2/69 |
| 2002/0078485 | A1 | 6/2002 | Ferreiro | |
| 2002/0120974 | A1 * | 9/2002 | Krause et al. | 2/129 |
| 2004/0016041 | A1 * | 1/2004 | Uno et al. | 2/113 |
| 2004/0107479 | A1 * | 6/2004 | Dicker et al. | 2/227 |
| 2005/0204448 | A1 * | 9/2005 | Wise et al. | 2/69 |
| 2005/0246813 | A1 * | 11/2005 | Davis et al. | 2/69 |
| 2007/0022510 | A1 * | 2/2007 | Chapuis et al. | 2/69 |
| 2007/0028351 | A1 | 2/2007 | Coolik | |
| 2007/0271668 | A1 * | 11/2007 | Pape | 2/69 |
| 2007/0294801 | A1 | 12/2007 | Furgerson et al. | |
| 2008/0194181 | A1 * | 8/2008 | Sudo et al. | 450/123 |
| 2008/0271226 | A1 * | 11/2008 | Erana Ahumada | 2/228 |
| 2010/0088803 | A1 * | 4/2010 | Orloff | 2/228 |
| 2010/0218298 | A1 | 9/2010 | Stattelmann et al. | |
| 2011/0296580 | A1 * | 12/2011 | Demarest et al. | 2/69 |
| 2011/0302686 | A1 * | 12/2011 | Chapuis | 2/69 |
| 2012/0128943 | A1 | 5/2012 | Wangbunyen et al. | |
| 2012/0174282 | A1 * | 7/2012 | Newton et al. | 2/69 |
| 2012/0311760 | A1 * | 12/2012 | Puni | 2/69 |
| 2013/0031695 | A1 * | 2/2013 | Roemer et al. | 2/84 |
| 2013/0104280 | A1 * | 5/2013 | Boynton | 2/79 |
| 2013/0167285 | A1 * | 7/2013 | Decker | 2/69 |
| 2014/0109282 | A1 * | 4/2014 | White et al. | 2/69 |
| 2014/0338089 | A1 * | 11/2014 | Brooks et al. | 2/2.15 |

* cited by examiner

GOLF SHIRT WITH IMPROVED FIT AND CONTRAST

CROSS-REFERENCE TO RELATED APPLICATIONS

This application claims the benefit of U.S. Provisional Application No. 61/824,797, filed May 17, 2013, entitled GOLF SHIRT WITH IMPROVED FIT AND CONTRAST, the entirety of which is incorporated by reference herein.

STATEMENT REGARDING FEDERALLY SPONSORED RESEARCH OR DEVELOPMENT

Not applicable.

TECHNICAL FIELD

The present invention relates to a shirt. More specifically, the present invention relates to a golf shirt with a fit improved to limit wearer distraction. The present invention may further relate to a golf shirt with increased contrast bands to facilitate video swing analysis.

BACKGROUND

Athletes increasingly rely on the garments they wear to improve their athletic performance. For example, a swimmer may wear a suit that decreases drag, while a football player may wear a glove to help grip and secure a football. At the very least, most athletes prefer to wear garments that promote rather than interfere with their performance.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

Golf shirts, including their sleeves, may be somewhat loose-fitting to accommodate the swing of the golfer. Although comfortable, the sleeves of many golf shirts may distract the golfer. For example, the sleeves may bunch, rub, flap or otherwise irritate the wearer when the wearer addresses the golf ball.

At a high level, the present invention is directed toward a shirt having a torso portion, a sleeve portion, and a collar portion and being designed to minimize distractions to a wearer when the wearer addresses a golf ball. The torso portion and the sleeve portion each have a front and a back. Along the back of the torso portion and the sleeve portion are located a pair of laterally opposed textile bands that may be similarly or identically shaped. The textile bands may be affixed or adhered to a back side of the torso portion and sleeve portion of the shirt using adhesives, stitching, or other attachment methodologies. A first end of each band is located at the skirt of the collar portion. A second end is located at or near a free end or cuff of the sleeve portion. One side of each band may be affixed to the shirt at a location between the skirt of the collar portion and the free end or cuff of the sleeve portion.

The textile bands may be constructed from a material that is different than the material used to construct the torso portion and the sleeve portion. In particular, the textile bands may be made of a material that is less stretchable than the material used to construct the torso portion and the sleeve portions. The bands may also have a different thickness, weight, rigidity, and/or elasticity than the torso and sleeve portions. Thus, with the present shirt, when a wearer extends his or her arms in front of his or her body to address a golf ball, the less stretchable material comprising the textile bands causes the sleeves to pull up and away from the wearer's arm, thereby reducing potentially distracting contact at the critical moment of ball address.

Additional features of the shirt, such as the incorporation of ventilation holes at the back of the collar portion and the incorporation of ultrasonically bonded seams at least on the sleeve portions, improve the comfort of the shirt and minimize distractions to the wearer. As well, using textile bands having a high contrast with the textiles of the torso portion and the sleeve portions may facilitate evaluation of an alignment of the wearer's golf swing through video analysis or other visual appraisals of swing mechanics.

BRIEF DESCRIPTION OF THE DRAWINGS

Examples are described in detail below with reference to the attached drawing figures, wherein.

DETAILED DESCRIPTION

At a high level, the present invention is directed toward a shirt designed to minimize distractions to a wearer when the wearer addresses a golf ball. The shirt provides two textile bands affixed to the back shoulder and torso portions of the shirt and having a first end located at or near the skirt of a collar portion and a second end located at or near a cuff or free end of a sleeve portion. As well, in one example, the shirt may have a plurality of ventilation holes located at the back of the collar portion, the holes increasing the breathability and moisture release of the shirt. In another example, a band may be connected to a center location of the skirt of the collar portion and extending down the back of the shirt to a cuff or terminal end of the shirt. The band may overlay a seam that joins two back panels of the torso portion of the shirt. If outwardly visible, the band may visually contrast with the torso portion and the sleeve portion of the shirt, although a band may be positioned at a desired location on a shirt that does not overlay a seam. The visual contrast of the band with other portions of a shirt may be useful during video analysis. For example, video or streaming images of the wearer may be captured and evaluated to determine the position of the wearer's body parts or an alignment of the wearer's golf swing, in which case the bands may facilitate the evaluation of a wearer's swing mechanics.

Figure 1:
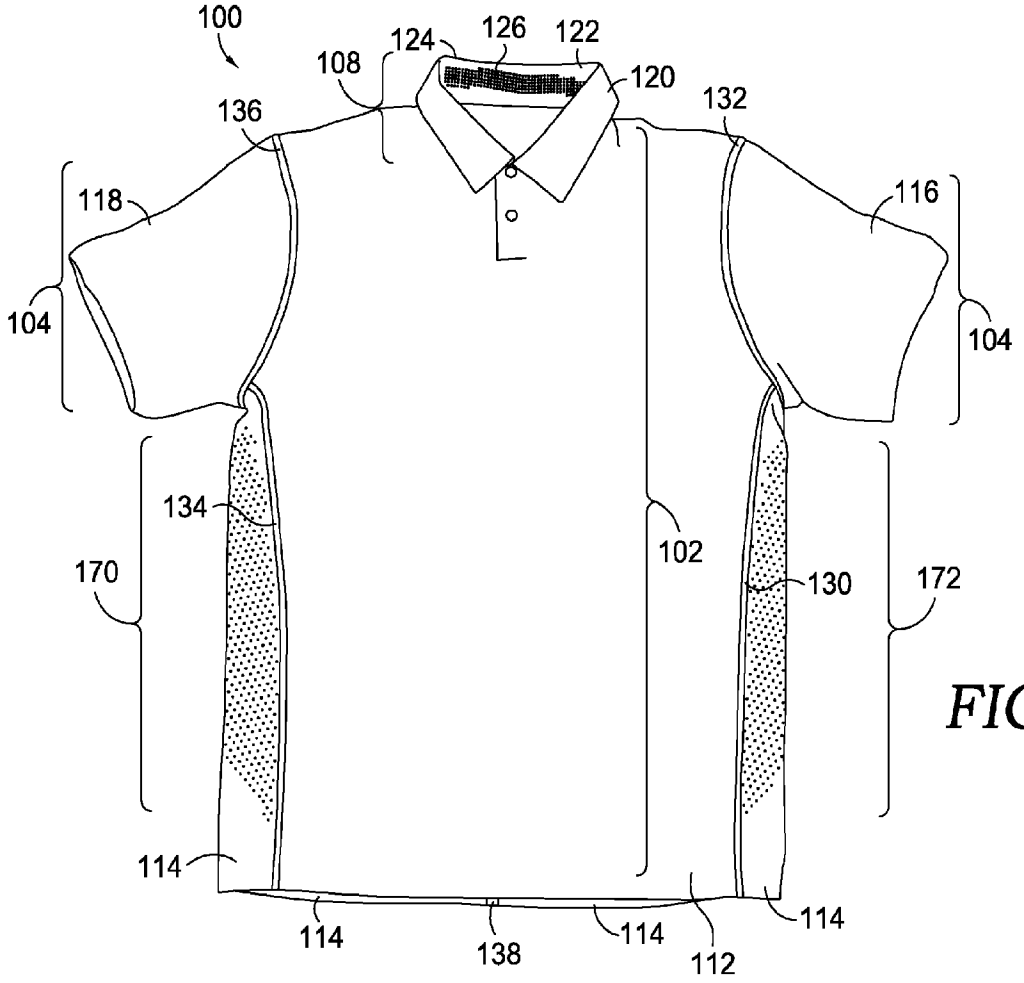
FIG. 1 depicts a front perspective view of a shirt in accordance with an example of the present invention.
Figure 2:
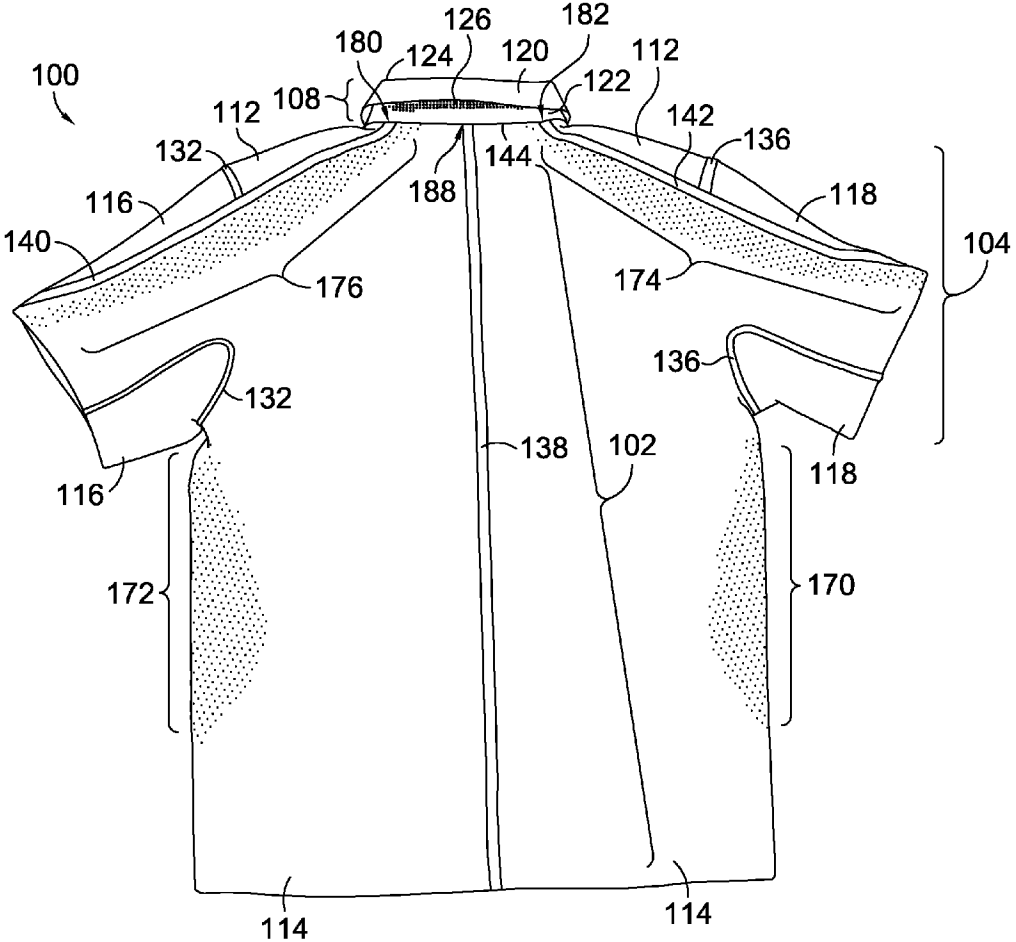
FIG. 2 depicts a back perspective view of the shirt depicted in FIG. 1, illustrating exemplary textile bands positioned thereon.

FIGS. 1-2 illustrate a shirt 100 designed to cover a portion of the arms and torso of a wearer when the shirt 100 is worn in accordance with an example of the present invention. A torso portion 102 covers the torso of a wearer. The torso portion 102 is constructed of a panel 112 and a panel 114. The panel 112 is located on a front side of the shirt 100. The panel 114 is located on the back and partially on the front side of the torso portion 102.

Figure 7:
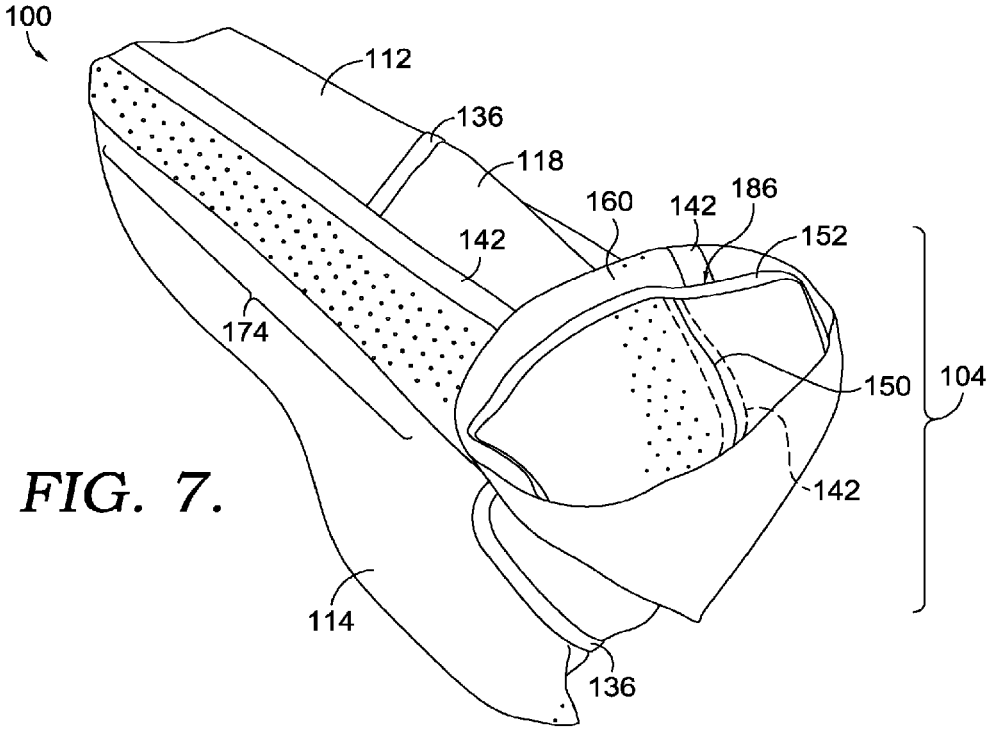
FIG. 7 depicts a perspective view of a sleeve portion of the shirt depicted in FIG. 2, illustrating an exemplary seam.
Figure 8:
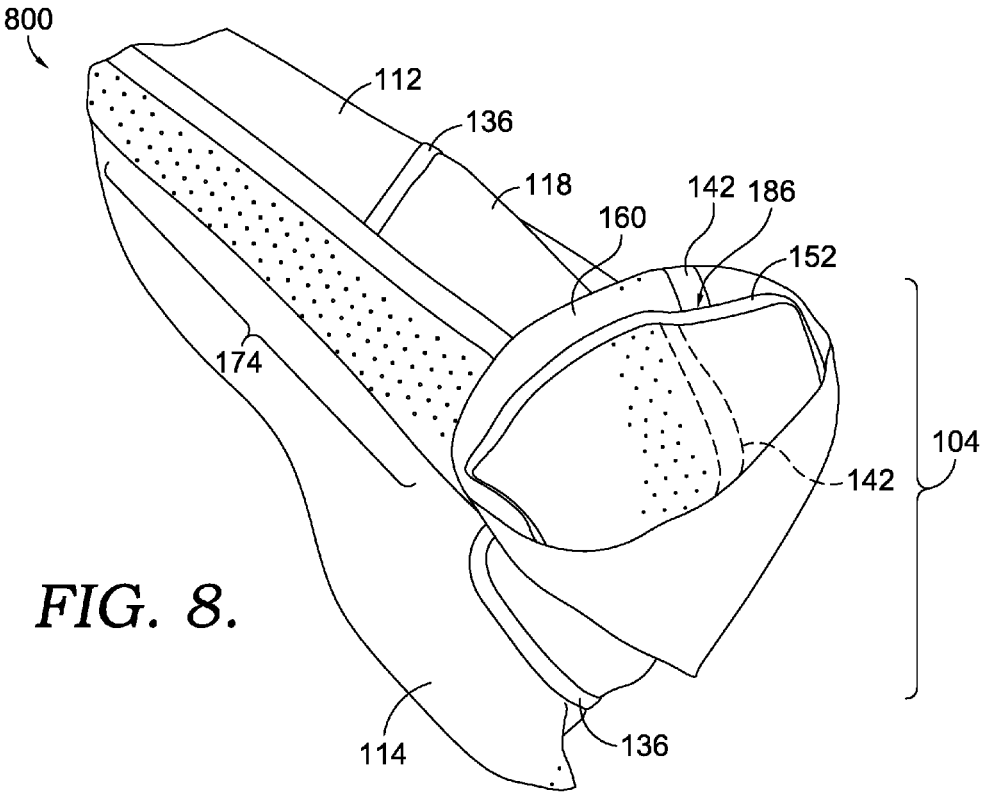
FIG. 8 depicts a perspective view of a sleeve portion of a fourth exemplary shirt.
Figure 9:
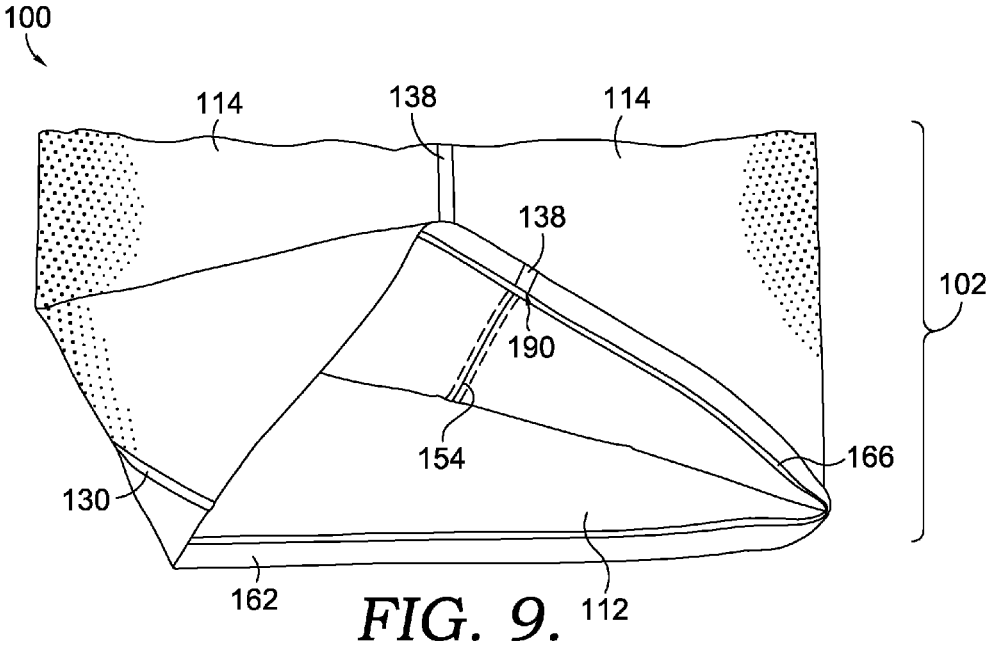
FIG. 9 depicts a back perspective view of a lower portion and inner and outer face of the shirt depicted in FIG. 2.

Sleeve portions 104 cover the arms of a wearer when the shirt 100 is worn. Sleeve portions 104 comprise shoulder portions 116 and 118, panel 114, and cuff portions 160 and 164 (as shown in FIGS. 7-9). Shoulder portions 116 and 118 extend from the cuff portions 160 and 164 to the shoulder of a wearer where they partially encircle an upper portion of the arm of wearer. Shoulder portions 116 and 118 are located on the front and partially on the back of the sleeve portions 104. The panel is located on the back of the sleeve portions 104. A portion of panel 114 extends to an arm of the wearer. The panel 114 may cover the back arm of a wearer in an as-worn position. The shoulder portions 116 and 118 and panel 114 may comprise a short sleeve, or, rather, a sleeve that terminates above the elbow of a wearer in an as-worn position. The cuff portions 160 and 164 encircle an upper portion of the arm of wearer.

Figure 5:
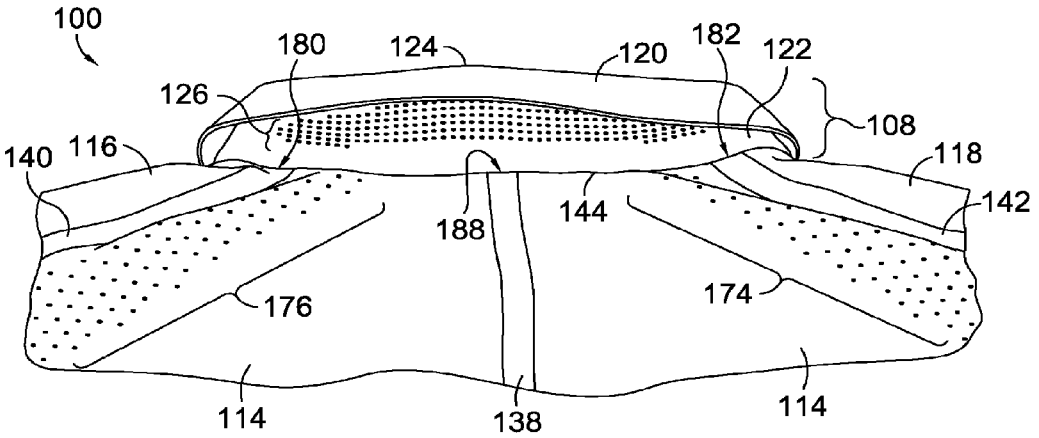
FIG. 5 depicts a back perspective view of a folded collar portion of the shirt depicted in FIG. 2.
Figure 6:
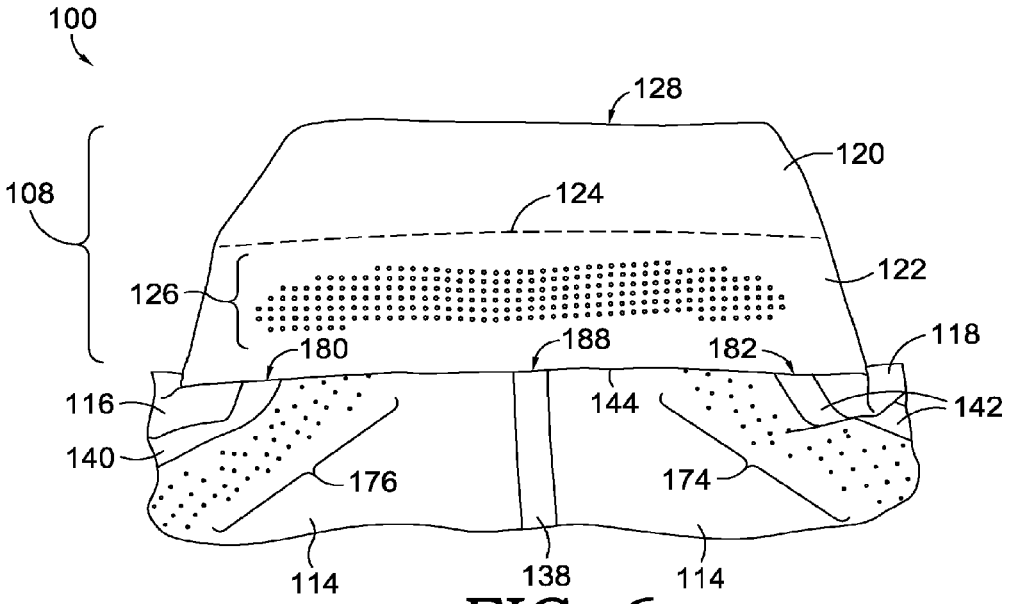
FIG. 6 depicts a back perspective view of an unfolded and ventilated collar portion of the shirt depicted in FIG. 2.

FIGS. 5-6 illustrate a collar portion 108 of the shirt 100 in accordance with an example of the present invention. Collar portion 108 is comprised of a lower collar 122, an upper collar 120, a fold 124, and a ventilation portion 126. The fold 124 allows the upper collar 120 to fold over the lower collar 122. The lower collar 122 may partially or completely encircle the wearer's neck. One or more buttons or other fasteners may be adhered, stitched or affixed to the panel 112 and may join the each of the terminal ends of the lower collar 122 at a point in front of the wearer's neck.

Each of the lower collar 122 and the upper collar 120 may be formed by a single piece of fabric folded over at fold 128 to form an inner layer (i.e., a layer that faces the neck of the wearer in a popped-up orientation) and an outer layer (i.e., a layer that faces away from the neck of the wearer in the popped-up orientation) of the lower collar 122 and the upper collar 120. The ventilation portion 126 may be aligned with and located between the lower layer and the upper layer of the lower collar 122. The ventilation portion 126 may be a rigid or semi-rigid material fused to one or both of the lower layer and the upper layer of the lower collar 122. The ventilation portion 126, as well as the lower collar 122, may be perforated and aligned before they are joined together. In some examples, ventilation portion 126 and lower collar 122 may comprise a single material. The perforations may create the plurality of holes that are shown on the back of the lower collar 122. The holes are intended to improve the breathability and moisture release of the shirt 100. The number and configuration of the holes are merely exemplary. Any number, size or configurations of the ventilation holes are considered to be within the scope of the examples described herein.

The shoulder portions 116 and 118 are made of a first textile. Panels 112 and 114 may also be made of the first textile or a substantially similar material. The first textile may be stretchable, lightweight, foldable, pliable, elastic, or the like. For example, the shoulder portions 116 and 118 and the panels 112 and 114 may be made of a textile containing spandex. One or more textile panels may be formed from polyester, nylon, cotton, spandex, or other fibers or fiber blends.

Figure 3:
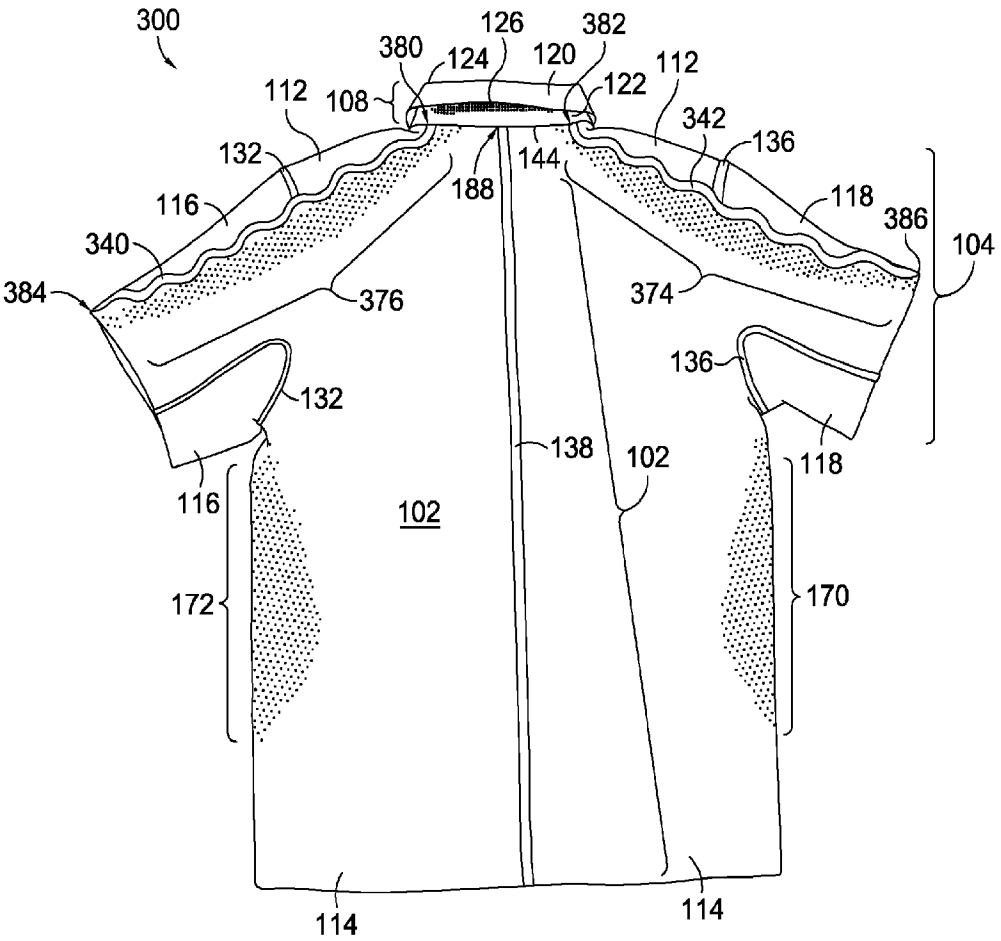
FIG. 3 depicts a back perspective view of a second exemplary shirt, illustrating exemplary textile bands positioned thereon.
Figure 4:
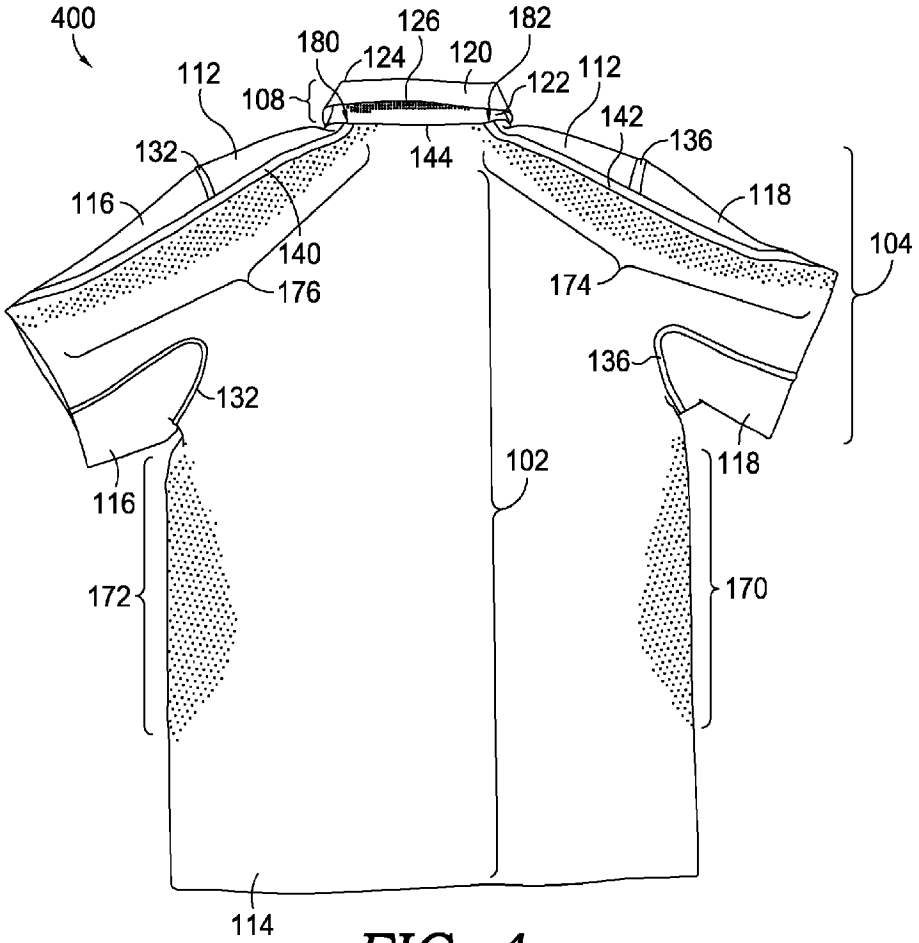
FIG. 4 depicts a back perspective view of a third exemplary shirt, illustrating exemplary textile bands positioned thereon.

The textiles used to form the torso portion 102 and the sleeve portions 104 may also be comprised of a plurality of ventilation holes. Illustrative ventilation zones 170, 172, 174 and 176 are shown in FIGS. 1-2 and 4-10. As well, illustrative ventilation zones 374 and 376 are shown in FIG. 3. The exemplary ventilation zones have ventilation holes that are indicated by the small circle patterns located on the shoulder and side locations of the shirts 100 and 300. Ventilation zones may be formed by varying the weave or knit of a textile to provide an open structure, by cutting holes in a textile, by dissolving one or more reactive yarns, by forming a ventilation zone from an open material, etc. With respect to shirt 100, the ventilation zones 170 and 172 partially extend to a front, a side and a back of the shirt 100. The ventilation zones 170 and 172 wrap around the side of the wearer. The ventilation zones 174 and 176 are positioned adjacent to the bands 140 and 142 but further away from the front of the shirt. The ventilation holes of ventilation zones 170 and 172 may decrease in number as they move in a horizontal direction away from a substantially center portion of the side of the shirt 100. The ventilation holes of ventilation zones 174 and 176 may decrease in number as they are positioned further from the bands 140 and 142. Ventilation zones 374 and 376 of shirt 300 illustrate that the configuration of ventilation holes may change depending on the configuration of the bands (e.g., bands 340 and 342). The ventilation holes may additionally or alternatively be located in other locations where the wearer is most likely to perspire. The ventilation holes that are shown on the torso portion 102 and sleeve portions 104 are merely exemplary and are not intended to limit the scope of the description provided herein to the precise location and number of the holes shown.

The upper collar 120 and the lower collar 122 of the collar portion 108 may also be made of the first textile. Alternatively, the upper collar 120 and the lower collar 122 may be made of a second textile, including a textile that is heavier, less pliable, and/or less stretchable. For example, the first textile may be a lightweight spandex blend, and the second textile may be a cotton-spandex knit blend. The ventilation portion 126 may be constructed from an entirely different textile than the textiles used to construct the upper collar 120 and the lower collar 122 and/or the torso portion 102 of the shirt 100. Particularly, the ventilation portion 126 may be constructed from a more rigid fabric or material, such as a plastic, foam, dense cloth, board, etc., than that used to construct the torso portion 102, the sleeve portions 104, or the upper collar 120 and lower collar 122.

Figure 10:
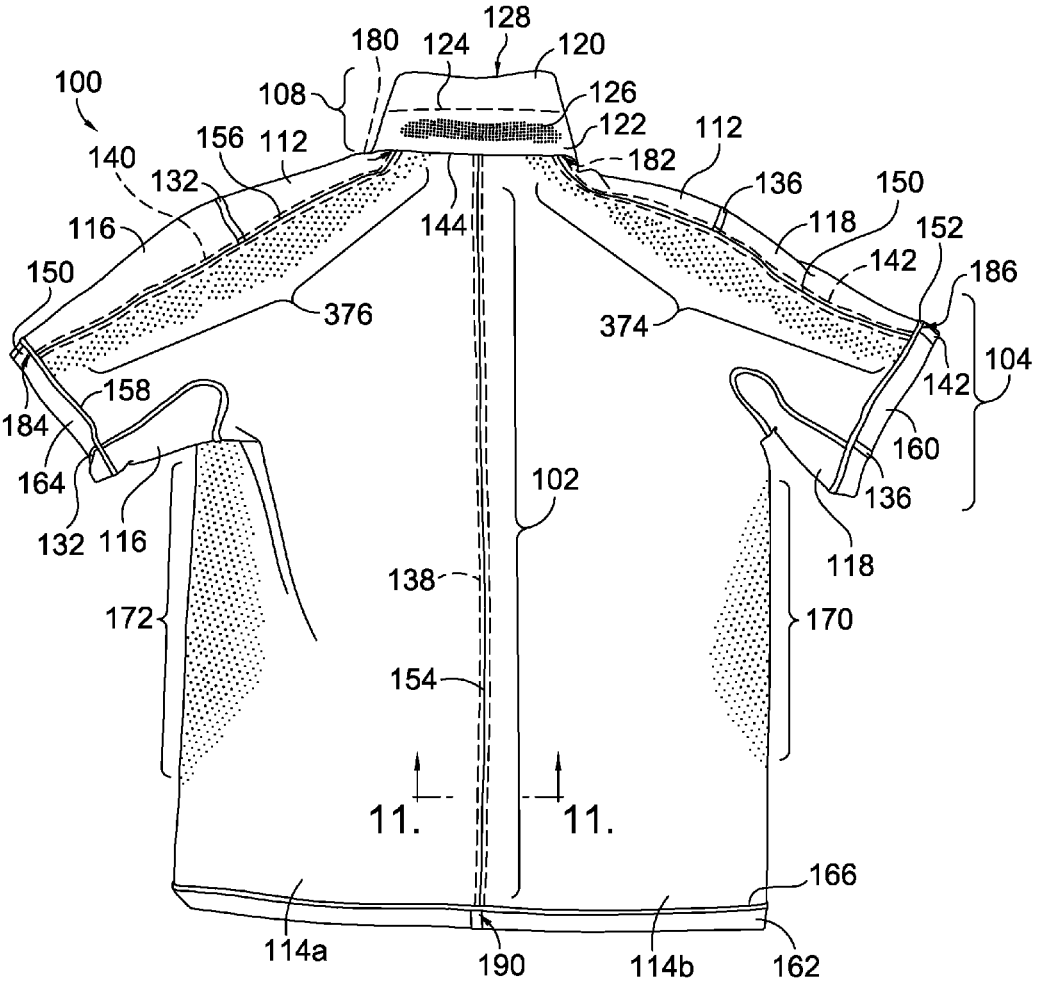
FIG. 10 depicts a perspective view of an inner face of the shirt depicted in FIG. 2.

As shown in FIGS. 1-2 and 10, the panel 112 is connected to the panel 114 at each of seams 130 and 134. The shoulder portions 116 and 118 are connected to the panel 112 at each of seams 132 and 136, respectively. Seams 132 and 136 also join panel 114 to each of shoulder portions 116 and 118 at or near the underarm of a wearer, respectively. Seam 144 joins panel 114 to the lower collar 122, while also joining shoulder portions 116 and 118 to the lower collar 122. In one example, additional seams, such as seams 156 and 150 as shown in FIG. 10, respectively join panel 112 and sleeve portion 116 to panel 114 and join panel 112 and sleeve portion 118 to panel 114. The seams 130, 132, 134, 136, 144, 150 and 156 join the panels 112 and 114, the shoulder portions 116 and 118, and the lower collar 122 substantially along the edges of the panels, shoulder portions and the collar to form the shirt 100.

The seams 130, 132, 134, 136, 144, 150 and 156 may be presented in a straight line, a curved line, a wavy line, or any other useful or visually appealing shape. The seams 130, 132, 134, 136, 144, 150 and 156 may be stitched or bonded using adhesives, tape, welding, etc. Additionally or alternatively, an adhesive tape suitable for bonding may be placed on one or more of the inner face or the outer face of a seam, and an ultrasonic energy, heat or other application of energy may be used to activate the tape and join the corresponding panels 112 and 114, shoulder portions 116 and 118 and/or collar portion 108. As well, the seams 130, 132, 134, 136, 144, 150 and 156 may be ultrasonically bonded without the use of an adhesive tape. For example, if the fabric used to create the panels 112 and 114 has adhesive properties, or if the fabric is joinable by the application of heat, pressure, or ultrasonic energy, the seams 130 and 134 may be created without ultrasonic energy.

As shown in FIGS. 2 and 10, at the back of the shirt 100, a pair of bands 140 and 142 each overlay the torso portion 102 and the sleeve portions 104. The textile bands 140 and 142 have first ends 180 and 182 and second ends 184 and 186, respectively. The first ends 180 and 182 of bands 140 and 142 may be affixed or adhered to the skirt of the collar portion 108 at seam 144, as shown. The first ends 180 and 182 are spaced at a same distance away from a center of the shirt 100 in laterally opposed locations. The second ends 184 and 186 of the bands 140 and 142 may be affixed or adhered to the cuff portion 160 and 164 of the sleeve portions 104 and abut the seams 158 and 152, respectively, as shown in FIGS. 7 and 10. Thus, the second ends 184 and 186 may be located on an inner face of the shirt 100 or affixed to the sleeve portions 104 in any location that allows for the functionality of the bands to be achieved, as described herein. As well, the second ends 184 and 186 may be located at a terminal end or at a point on the length of each of the shoulder portions 116 and 118. The length of the bands 140 and 142 (i.e., the material between the first end and the second end) contacts the shirt on one of its sides in a manner that prevents buckling or bunching of the underlying fabric. In other words, one side of the length of the bands 140 and 142 may be laid completely against the shirt 100 along all or part of the length of the bands 140 and 142. As well, the description provided herein, unless explicitly stated otherwise, applies equally to the first ends 380 and 382 and the second ends 384 and 386 of the bands 340 and 342 depicted in FIG. 3.

Similar to the first ends 180 and 182 and the second ends 184 and 186 of the bands 140 and 142, the lengths of the bands 140 and 142 are positioned at laterally opposed locations to each other. The laterally opposed locations of the bands may correspond to laterally opposed body parts of the wearer of in an as-worn position. For example, the bands 140 and 142 may each be located over a shoulder blade and back of a wearer's arm (e.g., the wearer's triceps) when the wearer is wearing the shirt and/or at a point where panel 112 joins panel 114 at each side of the wearer.

The bands 140 and 142 (and the bands 340 and 342 illustrated in FIG. 3) are made of a material or textile that is different than the textile used to construct the torso portion 102 and the sleeve portions 104. The material or textile used to construct the bands 140 or 142 may be less stretchable and/or more rigid than the material or textile used to construct the sleeve portions 104 and the torso portion 102. Similarly, the bands 140 and 142 may be constructed from a textile or material with less elasticity than the textile used to construct the sleeve portions 104 and the torso portion 102. Bands 140 and 142 may be made entirely or partially from natural or synthetic films, knit or woven textiles, heat transfer structures, etc. When a wearer extends his arms slightly upward and in front of his body and/or clasps his hands around a golf club and extends his arms at the address of the golf ball, the bands 140 and 142 hold up the sleeve portions 104 slightly away from the wearer's body/arms. In this way, the bands 140 and 142 serve to decrease a distraction associated with rubbing, flapping or bunching of the sleeve portions 104 around the arm of the wearer.

The enhanced stretchability of the torso portion 102 and the sleeve portions 104, as compared to the bands 140 and 142, aids the bands 140 and 142 in pulling up the sleeve portions 104. Additionally, when the torso portion 102 and the sleeve portions 104 are constructed from a lighter-weight fabric, the bands 140 and 142 more easily are able to pull the sleeves at least partially away from the arm of the wearer. The positioning of the ventilation zones 174 and 176 may also contribute to a multidirectional stretch of the panel 114, allowing for the bands 140 and 142 to more easily pull the panel 114 and the attached shoulder portions 116 and 118 away from the wearer's arm.

Stated differently, a golf shirt torso portion that is adapted to extend around at least a portion of a wearer's torso in an as-worn position has a front (e.g., anterior) and a back (e.g., posterior). The torso portion also has an inner (e.g., interior) surface and an opposite outer (e.g., exterior) surface. The golf shirt is also comprised of two sleeve portions that are connected to the torso portion at two respective shoulders. The shoulders may be a region or a general relative connection location identifier, as is typical of golf-type shirts. Each of the two sleeve portions has a front, a back, and a cuff. The cuff is opposite the connection of the sleeve to the torso portion that is proximate the shoulder region. The sleeve portions also have an inner and an opposite outer surfaces.

In an effort to limit the stretch of the golf shirt in a strategic manner, the amount of stretch along a specified path is limited, in an exemplary aspect, with the inclusion of bands. As a result, the torso and sleeve portions may be formed from an elastic (e.g., relatively high stretch) material for comfort of the wearer, while limiting the stretch of the shirt as a whole when addressing a golf ball (e.g., a position where the sleeve portions are extending in an anterior direction as an angle measured at the shoulder that is greater than when the sleeves are parallel with the torso). The bands may extend across the shoulder region on the posterior side and along the sleeves such that as the wearer addresses the golf ball, the shirt is limited in a stretch in the anterior direction across the location on which the bands extend. The bands have a first end, a second end, and a length. The first end, in an exemplary aspect, is connected to a skirt of a collar (e.g., posterior location along a neckline), the second end being connected to the cuff of a sleeve portion, the length being connected to a back side (e.g., posterior) of the golf shirt in a location extending from the base of the collar (e.g., skirt) to the cuff, in an exemplary aspect.

As shown in FIG. 3, a shirt 300 is shown having bands 340 and 342, which are configured to be many different shapes and lengths without departing from the functionality described herein. The bands 340 and 342 may be wavy or curvy, as shown. The bands 340 and 342 may also be thicker, narrower, longer or shorter than the exemplary bands 340 and 342 shown. Similarly, while the bands 140, 142, 340 and 342 of FIGS. 2-3 overlay the outer face of the shirt 100 and the shirt 300, respectively, the bands may be stitched or adhered to the inner face of the shirt.

FIG. 10 illustrates the shirt 100 with bands 140 and 142 that overlay seams 150 and 156, respectively, in accordance with an example of the present invention. When the bands 140 and 142 do overlay a seam (e.g., seams 156 and 150), the seam may touch the bands 140 and 142 in a manner so as to divide the bands 140 and 142 into two equal portions lengthwise, as shown in FIG. 10. As shown in FIG. 8, the bands 140 and 142 may not overlay a seam. It is also possible for the bands 140 and 142 to overlay only a portion of a seam of a shirt 800.

Figure 11:
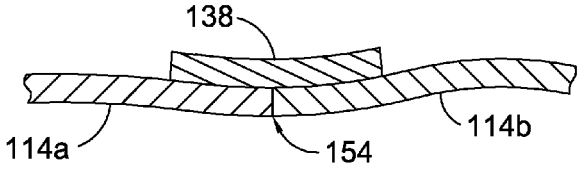
FIG. 11 depicts a cross-section of a seam and textile band of the shirt depicted in FIG. 10.

Returning to FIG. 2 and turning to FIGS. 9-11, a band 138 may have a first end 188 positioned at the seam 144 and a second end 190 extending to the terminal end of the shirt 100 or bottom cuff 162, where it abuts a seam 166. The band 138 may visually divide the panel 114 into two equal portions, and, similar to the bands 140 and 142, may be rectangular-shaped. Band 138 may be formed from a variety of materials such as described above with regard to bands 140 and 142. Band 138 may also be wavier, curvier, thicker, narrower, longer, shorter, and the like than the band 138 shown. The panel 114 may be comprised of two equal panels, panel 114*a* and panel 114*b*. If so, the band 138 may overlay a seam 154 that bonds panel 114*a* to panel 114*b*, as shown in FIGS. 10-11. The band 138 may be made of a same or a different material than the material used to create the bands 140 and 142. In some examples, it is possible for a shirt 400 to not have the band 138. Further, the band 138 may be referred to as a third band when the band 138 and the bands 140, 142 are included in the shirt 100, 300.

The bands 140 and 142 and/or the band 138 may comprise visual markers used to measure an alignment of a wearer's golf swing or the movement of the wearer. For example, the position of the bands 138, 140, and 142 may be compared to corresponding body parts to determine the relative position of the body parts when the shirt 100 is worn. The body parts that normally correspond to the position of the bands 138, 140 and 142 may comprise, for example, the shoulders, triceps, and the back/spine. Additionally, the location of the bands 138, 140 and/or 142 with respect to each other may provide an indication of the relative movement or positioning of the wearer. Similarly, the bands 138, 140, and/or 142 can be constructed from a material having a pattern, shading, hue, color, texture, reflective coating, luminance, reflectance or other visual trait that contrasts the bands 138, 140, and/or 142 with one or more of the torso portion 102, the sleeve portions 104, or the collar portion 108. For example, the bands 138, 140, and/or 142 may be darker in color than the torso portion 102. Similarly, the bands 138, 140, and/or 142 may be lighter than the torso portion 102 of the garment. The visual contrast between the bands 138, 140, and/or 142 and the other portions of the shirt 100 aid a viewer in determining the movement or alignment of the wearer's body. Any combination of a variety of visual properties may be used to define the bands 138, 140, and/or 142 in relation to the shirt 100 in accordance with the present invention. As well, a wearer may use the shirt 100 having bands 138, 140 and 142 during video training to measure the accuracy of his or her golf swing and/or putting stance, for example.

The present invention has been described in relation to particular examples, which are intended in all respects to be illustrative rather than restrictive. From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims

What is claimed is:

1. A golf shirt comprising:

a torso portion that is adapted to extend around at least a portion of a wearer's torso in an as-worn position, the torso portion having a front and a back;

two sleeve portions connected to the torso portion at two respective shoulders, each of the two sleeve portions having a front, a back, and a cuff;

a plurality of ventilation holes located at a plurality of ventilation zones positioned about the shirt, the plurality of ventilation zones comprising a first, second, third, and fourth ventilation zones;

a pair of textile bands, each of the pair of textile bands having a first end, a second end, and a length, the first end being connected to a skirt of a collar, the second end being connected to the cuff of the sleeve portions, the length being connected to a back side of the golf shirt in a location extending from the collar skirt to the cuff; and a third textile band having a top end, a bottom end, and a third length, the top end being connected to the collar skirt, the bottom end being connected to a bottom cuff of the back torso portion, the third length being connected to the back side of the golf shirt in a central location extending from the collar skirt to the bottom cuff, wherein the third textile band divides the back torso portion into two equal halves.

2. The golf shirt of claim 1, wherein each of the pair of textile bands overlay one side of a seam.

3. The golf shirt of claim 2, wherein the seam is created with an adhesive tape that is activated upon application of an ultrasonic energy.

4. The golf shirt of claim 1, wherein the length of each of the pair of textile bands is located over laterally opposed portions of the golf shirt that are adapted to coordinate with laterally opposed body parts of the wearer when in an as-worn position.

5. The golf shirt of claim 1, wherein the length of each of the pair of textile bands is located over laterally opposed portions of the golf shirt that are adapted to coordinate with laterally opposed arms and shoulder blades of the wearer in an as-worn position.

6. The golf shirt of claim 1, wherein the pair of textile bands limit the stretch of the golf shirt in a configuration for addressing a golf ball.

7. The golf shirt of claim 1, wherein the torso portion and the two sleeve portions are comprised of a first material, and wherein the pair of textile bands and the third textile band are comprised of a second material, and wherein the first material has a greater stretch than the second material.

8. A golf shirt comprising:

a torso portion that is configured to extend around at least a portion of a wearer's torso in an as-worn position, the torso portion having a front and a back and being comprised of a first material, the back comprising two equal panels;

two sleeve portions, each of the two sleeve portions having a front, a back, and a cuff and being comprised of the first material, the cuff at a distal end of each of the sleeve portions; and a plurality of ventilation holes located at a plurality of ventilation zones positioned about the shirt, the plurality of ventilation zones comprising a first, second, third, and fourth ventilation zones;

two seam bands, each of the two seam bands overlay panels located at one or more laterally opposed golf-shirt portions and being comprised of a second material, wherein the first material is different from the second material, and wherein a stretchability of the first material is greater than a stretchability of the second material; and a third seam band that is positioned adjacent to a seam joining the two equal panels of the back of the torso portion.

9. The golf shirt of claim 8, wherein the two seam bands reduce a movement associated with the two sleeve portions when the golf shirt is positioned for a wearer to addresses a golf ball.

10. The golf shirt of claim 8, wherein the two seam bands are located on an inner face of the golf shirt.

11. The golf shirt of claim 8, wherein the two seam bands are located on an outer face of the golf shirt.

12. A golf shirt comprising:

a torso portion adapted to extend around at least a portion of a wearer's torso in an as-worn position;

two sleeve portions connected to the torso portion at two respective shoulder regions;

two seams located on a back side of the golf shirt, each of the two seams bonding at least a front panel and a back panel of the torso portion and a front panel and a back panel of one of the two sleeve portions, the each of the two seams located over laterally opposed portions of the golf shirt;

a band that overlays an exterior side of each of the two seams, wherein the band is comprised of a material having less stretchability than a material used to form the torso portion and the two sleeve portions; and a plurality of ventilation holes located at a plurality of ventilation zones positioned about the shirt, the plurality of ventilation zones comprising a first, second, third, and fourth ventilation zone, wherein the first and the second ventilation zones are located on the front panel and the back panel of the torso portion and extend around the side of the wearer's torso in as-worn position, wherein the third and fourth ventilation zones are located on the back panel of each of the two sleeve portions and are positioned adjacent to each band.

13. The golf shirt of claim 12, wherein the laterally opposed golf shirt portions are adapted to correspond with a wearer's shoulder blade and an arm.

14. The golf shirt of claim 12, further comprising a collar connected to the torso portion.

15. The golf shirt of claim 14, wherein the collar comprises a semi-rigid portion located to correspond with a back of the wearer's neck when in an as-worn position, the semi-rigid portion having a ventilation portion with a plurality of holes extending through the semi-rigid portion.

16. The golf shirt of claim 15, wherein the semi-rigid portion is fused to an inner surface and an outer surface of the collar.

17. The golf shirt of claim 14, further comprising a third band that overlays a third seam, the third band having a length that extends from the collar to a free end of the torso portion at an inferior location relative to the collar.

18. The golf shirt of claim 17, wherein the back panel of the torso portion comprises two panels that are bonded together by the third seam.

19. The golf shirt of claim 18, wherein the third band comprises a material including a visual trait that contrasts the third band with the torso portion.

20. The golf shirt of claim 19, wherein a position of the third band divides the back panel into two equal portions.

* * * * *